United States Patent [19]

Watanabe et al.

[11] 4,148,165

[45] Apr. 10, 1979

[54] FIRE BRICK UNIT

[75] Inventors: Akira Watanabe, Okayama; Yukio Kusaka; Shigeo Sasaki, both of Bizen, all of Japan

[73] Assignee: Kyushu Taikarenga Kabushiki Kaisha, Bizen, Japan

[21] Appl. No.: 852,969

[22] Filed: Nov. 18, 1977

[30] Foreign Application Priority Data

Dec. 3, 1976 [JP] Japan ..... 51-164201[U]

[51] Int. Cl.[2] ..... E04C 1/24; T23M 5/02

[52] U.S. Cl. ..... 52/122; 52/513; 110/336

[58] Field of Search ..... 52/485, 488, 747, 122, 52/125, 513; 110/99 R, 99 A, 1 A, 1 B; 266/280–286

[56] References Cited

U.S. PATENT DOCUMENTS

| | | | |
|---|---|---|---|
| 1,875,667 | 9/1932 | Sheahan | 52/486 |
| 2,144,597 | 1/1939 | Reed et al. | 52/487 |
| 3,380,211 | 4/1968 | Snellman | 52/747 |

FOREIGN PATENT DOCUMENTS

| | | | |
|---|---|---|---|
| 222790 | 1/1962 | Austria | 110/340 |
| 537371 | 10/1952 | Canada | 110/99 A |
| 598730 | 6/1934 | Fed. Rep. of Germany | 52/122 |
| 1184625 | 2/1959 | France | 266/286 |
| 627600 | 11/1961 | Italy | 52/122 |

*Primary Examiner*—James L. Ridgill, Jr.
*Attorney, Agent, or Firm*—Wenderoth, Lind & Ponack

[57] ABSTRACT

A fire brick unit or assembly is proposed which has a pile of fire bricks laid one upon another on a supporting member to facilitate the building and dismantling of industrial furnaces. It further includes suspending members on which can be lifted with a crane or the like. There is no necessity of laying or removing fire bricks one by one.

5 Claims, 8 Drawing Figures

FIRE BRICK UNIT

BACKGROUND OF THE INVENTION

The present invention relates to fire brick units, and more particularly to fire brick units which are arranged to include a plurality of fire bricks, supporting means and suspending means.

Conventionally, walls of industrial furnaces, particularly electric furnaces, have been built and dismantled by laying or removing fire bricks manually one by one. This work was time-consuming and very hard in view of bad working conditions, i.e., hot air containing dust.

In order to obviate this drawback, methods have been proposed in which a number of fire bricks are assembled beforehand into units or blocks and such units are brought into a furnace by means such as a crane and the units are assembled to build the furnace wall. Such methods were effective to shorten the time required for building a furnace and to lighten the labor. However, in dismantling a furnace, fire bricks are still usually removed one by one with a pick or the like. Also, with this manual method, dismantling could not be started until the furnace had cooled sufficiently. This meant a large time loss.

BRIEF SUMMARY OF INVENTION

An object of the present invention is to provide fire brick units which facilitate both the building and dismantling of a furnace wall.

The present invention consists in fire brick units comprising a plurality of fire bricks, supporting means at bottom thereof, and suspending or lifting means at rear thereof.

Other features and objects of the present invention will become apparent from the following description taken with reference to the accompanying drawings.

DETAILED DESCRIPTION

In any of the embodiments, the fire brick unit generally designated by numeral 1 includes a plurality of fire bricks 2, supporting means 3 and suspending or lifting means 4.

Figure 1:
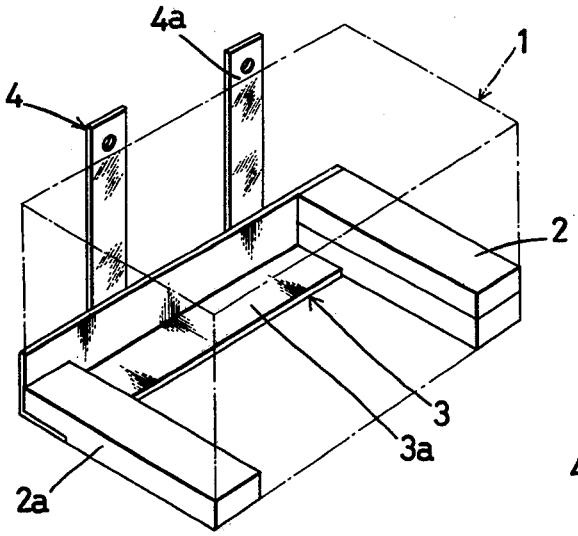
FIG. 1 is a perspective view of one embodiment of the fire brick unit according to this invention.

Referring to FIG. 1, a fire brick unit 1 has a plurality of fire bricks 2 laid one upon another on a supporting member 3*a* of L-section to which are secured two vertical suspending or lifting members 4*a*. A plurality of such units 1 are assembled to form a furnace wall.

Figure 2:
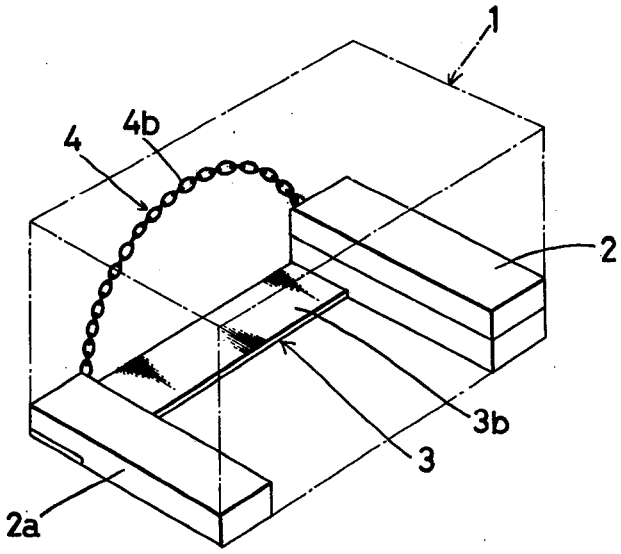
FIGS. 2, 3 and 3*a* are similar views of other embodiments.

FIG. 2 shows another embodiment which employs supporting means comprising a plate-like member 3*b* and suspending means comprising a chain member 4*b*.

Figure 3:
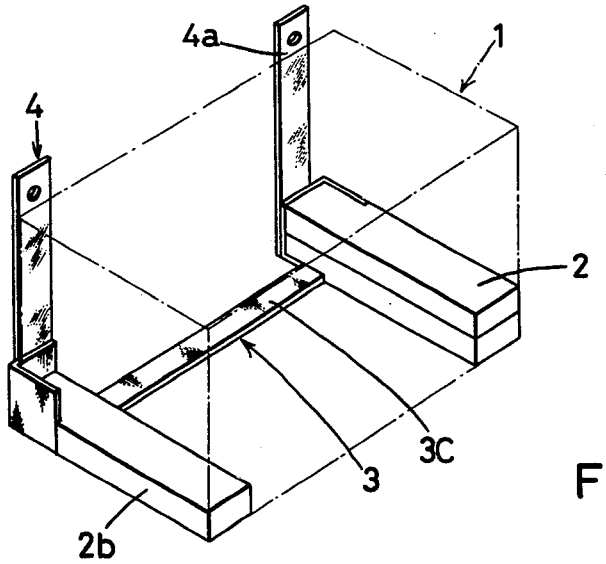

FIG. 3 shows another embodiment in which the supporting means is in the form of a member 3*c* to which are secured the suspending members 4*a*.

Figure 1A:
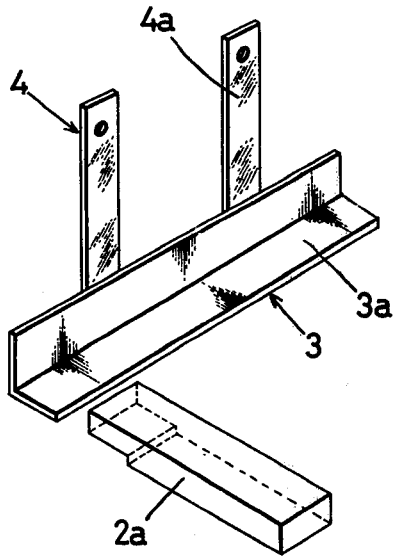
FIG. 1*a* is an exploded view of the embodiment of FIG. 1.
Figure 3A:
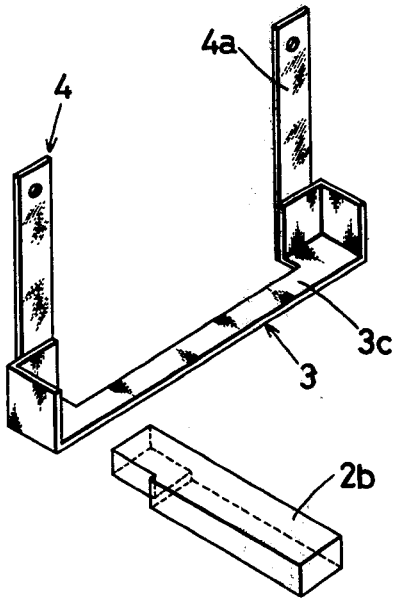

Preferably, the fire bricks 2*a* to be placed at the bottom of the unit have one or more portions chamfered as best shown in FIGS. 1*a* and 3*a* so as to fit snugly on the supporting member 3 and thereby eliminate any gaps which would be otherwise formed between the lowermost bricks and the floor which might allow the leakage of molten steel out of the furnace.

The fire bricks 2 may be held together in any suitable manner, for example, by adhering them together with an adhesive, by using angle irons 5 and/or band irons 6 (FIG. 5), by laying them in a casing, or by combining two or more of these methods.

The supporting means 3 should be disposed at the rear of the fire brick unit, namely, at the outer side of the furnace to prevent contact with steel bath or slag.

The suspending means 4 is secured to the supporting means 3 as by welding in these embodiments. With the plate-like members 4*a*, two or more are preferably provided for greater stability. If a chain (or wire) member 4*b* is employed as the suspending means, it is preferably disposed at the rear of the unit for the same reason as above and is adapted to be pulled out when needed.

When building or dismantling a furnace, the fire brick units 1 are carried into or out of the furnace, the suspending means 4 being suspended by means of a crane or the like. This greatly facilitates and speeds up the work over the conventional process.

In some cases, suspending the fire brick unit 1 by only the suspending means provided at rear thereof is unstable. Therefore, the suspending means are preferably provided at both at rear and front thereof, as with the embodiments of FIGS. 4, 5 and 6.

Figure 4:
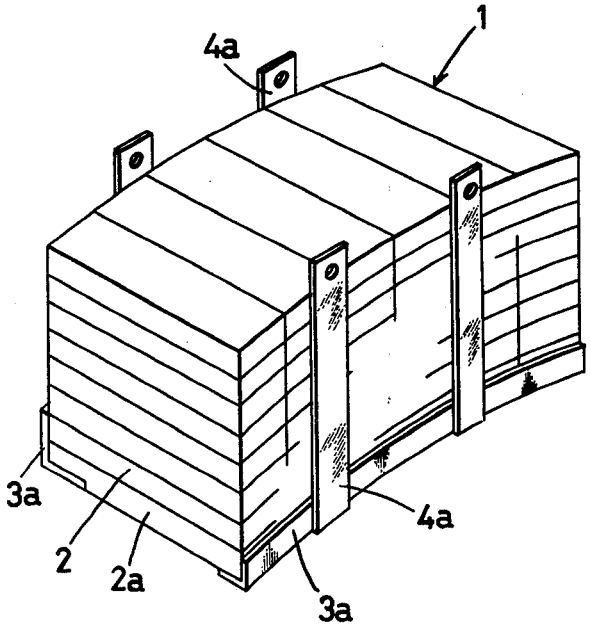
FIGS. 4, 5 and 6 are perspective views of another group of embodiments including suspending means both on the front and rear thereof.

FIG. 4 shows a variation of the embodiment of FIG. 1 having the supporting member 3*a* and the suspending members 4*a* both at the rear and front of the unit. These members at the front (that is, the side facing the inside of the furnace) are adapted to be removed after the furnace has been built.

Figure 5:
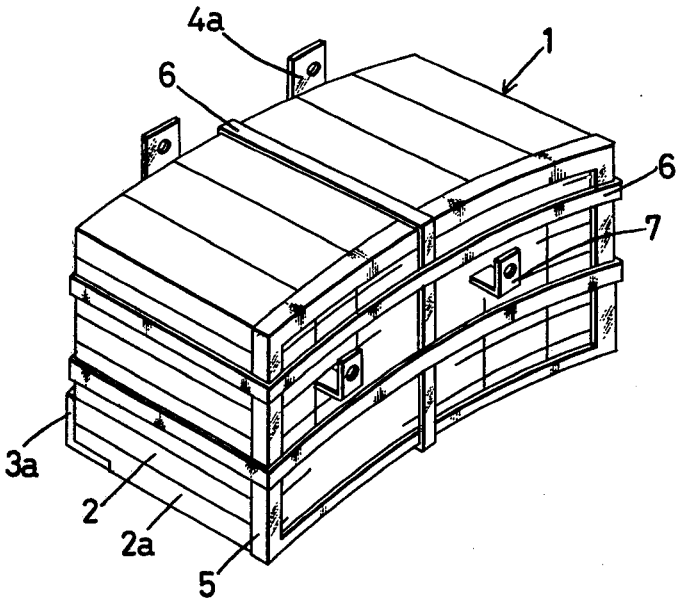

FIG. 5 shows a variation in which the fire bricks 2 are held together by means of an angle iron 5 and band irons 6 passing around the block of fire bricks. This embodiment has the suspending means 4, comprising two L-shaped metal fittings 7, fixedly embedded between the fire bricks at the front side thereof.

Figure 6:
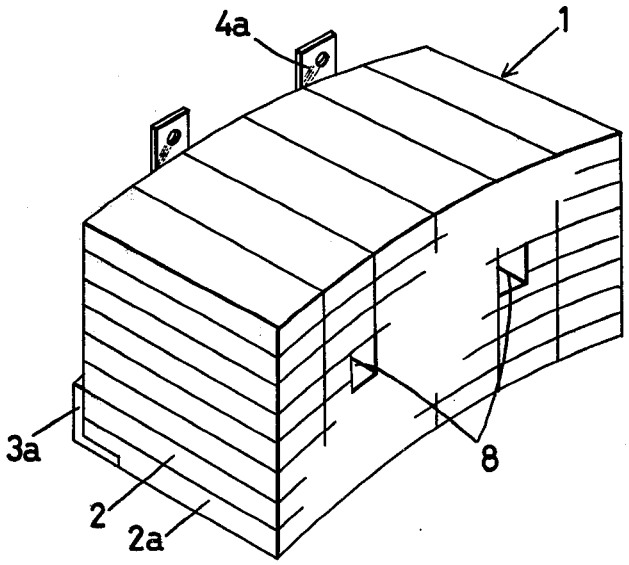

FIG. 6 shows a further variation which has two recesses 8 formed in the front side of the unit to serve as suspending means. The claws of a crane or the like are hooked therein.

While preferred embodiments have been described, it is to be understood that changes may be made within the scope of the following claims.

I claim:

1. A fire brick unit comprising:

a plurality of stacked fire bricks, said bricks being stacked side by side in rows, one row on top of the other;

a single support means extending underneath each brick in the bottom now of said stacked fire bricks for supporting said stacked fire bricks thereon;

suspending means connected to said support means and on the outside of said stacked fire bricks for lifting and carrying said support means and said fire bricks thereon; and binding means around said stacked fire bricks for binding said fire bricks together with said support means and said suspending means into a single unit.

2. A unit as claimed in claim 1, wherein said support means is a single L-shaped bar extending underneath each brick forming the bottom row of said fire bricks and extending upward along the edges of said fire bricks.

3. A unit as claimed in claim 1, wherein each brick on the bottom row of fire bricks is partially chamfered at the portion thereof resting on said support means.

4. A unit as claimed in claim 1, wherein said suspending means is a chain connected to said support means.

5. A unit as claimed in claim 1, wherein said support means and said suspending means are provided at both the front and rear of said stacked fire bricks.

* * * * *